US008620601B2

(12) United States Patent
Ueki

(10) Patent No.: US 8,620,601 B2
(45) Date of Patent: Dec. 31, 2013

(54) GAS CUTOFF APPARATUS

(75) Inventor: Kouichi Ueki, Nara (JP)

(73) Assignee: Panasonic Corporation (JP)

( * ) Notice: Subject to any disclaimer, the term of this patent is extended or adjusted under 35 U.S.C. 154(b) by 217 days.

(21) Appl. No.: 13/000,582

(22) PCT Filed: Jun. 23, 2009

(86) PCT No.: PCT/JP2009/002878
§ 371 (c)(1),
(2), (4) Date: Dec. 21, 2010

(87) PCT Pub. No.: WO2009/157188
PCT Pub. Date: Dec. 30, 2009

(65) Prior Publication Data

US 2011/0106461 A1 May 5, 2011

(30) Foreign Application Priority Data

Jun. 24, 2008 (JP) ..... 2008-164091

(51) Int. Cl.
*G01F 7/00* (2006.01)

(52) U.S. Cl.
USPC ..... 702/45; 702/39; 702/48; 702/50; 702/54; 702/100

(58) Field of Classification Search
USPC ..... 702/39, 45, 48, 50, 54, 100; 73/1.59, 73/152.21, 861.27, 861.356
See application file for complete search history.

(56) References Cited

U.S. PATENT DOCUMENTS 4,928,728 A * 5/1990 Nakane et al. ..... 137/486
7,885,790 B2 * 2/2011 Straub, Jr. ..... 702/182
2009/0035121 A1 * 2/2009 Watson et al. ..... 415/1

FOREIGN PATENT DOCUMENTS

JP 2005-061864 A 3/2005
JP 2005-214894 A 8/2005
JP 2005-257445 A 9/2005
JP 2005-315717 A 11/2005
JP 2006-133156 A 5/2006
JP 2006-242659 A 9/2006

OTHER PUBLICATIONS

International Search Report for International Application No. PCT/JP2009/002878, dated Sep. 1, 2009, pages.

* cited by examiner

*Primary Examiner* — Marc Armand
*Assistant Examiner* — Ivan Rabovianski
(74) *Attorney, Agent, or Firm* — Brinks Gilson & Lione

(57) ABSTRACT

An object is to detect an abnormality when the inside of a gas cutoff apparatus is submerged.

A flow rate computing unit 15 computes an instantaneous flow rate from a detected value of a flow rate detecting unit 8 for measuring a flow rate, and an amplification degree determining unit 18 determines signal amplification adjusted by the flow rate detecting unit 8, and timing is started when the amplification degree is a predetermined value or more, and a measurement condition setting unit 16 sets a measurement condition of the flow rate detecting unit 8 from the flow rate obtained by the flow rate computing unit 15, and a measurement ratio computing unit 20 obtains a measurement condition ratio during predetermined time from a time measuring unit 19 and the measurement condition setting unit 16, and it is determined that the flow rate detecting unit 8 is abnormal when the measurement ratio is a predetermined ratio or more, and a cutoff unit 22 breaks supply of gas.

4 Claims, 5 Drawing Sheets

GAS CUTOFF APPARATUS

TECHNICAL FIELD

The present invention relates to a gas cutoff apparatus, and particularly to the gas cutoff apparatus for preventing incorrect measurement or incorrect cutoff resulting from a malfunction in an electronic component etc. by infiltration of rainwater etc.

BACKGROUND ART

This kind of gas cutoff apparatus conventionally includes an apparatus as shown in FIGS. 4 and 5 (for example, see Patent Reference 1).

FIG. 4 shows a front view of a gas cutoff apparatus 1 and an adapter 2, and FIG. 5 is a sectional view of a Z-axis direction viewed from the side. The adapter 2 is configured to mount a control circuit 3 capable of adding a predetermined function to the gas cutoff apparatus 1 and be attachable to and detachable from the gas cutoff apparatus 1.

The gas cutoff apparatus 1 includes a gas inflow vent 1*a* and a supply vent 1*b* for supplying gas to gas use facilities etc. Also, a measuring unit (not shown) for measuring a gas flow rate is included inside the gas cutoff apparatus 1, and the gas flow rate which flows from the gas inflow vent 1*a* and is supplied from the supply vent 1*b* is measured. A display unit 1*c* is disposed in the front of the gas cutoff apparatus 1, and an integrated value etc. of usage are displayed. Also, a cutoff valve (not shown) for cutoff supply of gas at the time of abnormality detection is disposed, and a return operation part 1*d* for performing the abnormality detection and returning from a cutoff state of stopping the supply of gas is disposed. When a terminal lid 1*e* is detached, a connecting terminal 1*j* having a communication terminal etc. capable of connecting a communication device appears. In the case of connecting the control circuit 3 capable of adding the predetermined function to the gas cutoff apparatus 1, there are various functions, for example, a function of conducting wireless communication as the communication device or a function of storing gas usage at regular time intervals from the predetermined time and date.

In the adapter 2, as shown in FIG. 5, a case part has a box shape, and is constructed of a case body 2*b*, an outer lid part 2*c* and an inner lid part 2*d*. The control circuit 3 is accommodated inside this case and the adapter part 2 is constructed.

In the case body 2*b*, a portion of the side is formed in an opening and the control circuit 3 is accommodated from this opening. The inner lid part 2*d* covers the opening of the case body 2*b*, and is attachable and detachable. The outer lid part 2*c* further covers the inner lid part 2*d*, and is attachable and detachable. As shown in FIG. 4, a concave part 2*e* is disposed under the case body 2*b* and a corresponding convex part 2*f* is disposed under the inner lid part 2*d* and is fitted into the concave part 2*e*. Then, fixation is done by a fixing member (a screw etc.) 2*a*. A gap between the case body 2*b* and the inner lid part 2*d* is hermetically sealed using a hermetically sealing member (an O ring etc.) 2*g*, and infiltration of rainwater into the case body 2*b* is suppressed.

A wiring hole 2*h* for drawing wiring 1*h* of the control circuit 3 is disposed in the inner lid part 2*d*, and the wiring 1*h* passes through the wiring hole 2*h* of the inner lid part 2*d* from the control circuit 3 and further passes through a wiring hole 2*k* with a wiring seal member 2*j* of an adapter upper portion and passes through a wiring hole 1*k* disposed under the gas cutoff apparatus 1 and is further connected to the connecting terminal 1*j* disposed in a control circuit 1*g* for gas cutoff apparatus. The wiring 1*h* for connecting the control circuit 3 to the connecting terminal 1*j* is drawn from the upper portion of the adapter 2 and the terminal lid 1*e* is attached to the gas cutoff apparatus 1 by a fixing member if and thereby, the wiring 1*h* is accommodated inside the gas cutoff apparatus 1 and is constructed so as not to be exposed to the outside.

PRIOR ART REFERENCE

Patent Reference

Patent Reference 1: JP-A-2005-61864

DISCLOSURE OF THE INVENTION

Problems that the Invention is to Solve

However, in the conventional configuration, when a terminal lid is fastened by a fixing member after a person in charge of work for installing a gas cutoff apparatus opens the terminal lid of the front and connects wiring in order to connect the wiring from a communication device, an alarm or a controller, there are cases where two places to be fixed are accidentally fixed in only one place or are fixed in a state of pinching some substance, with the result that a gap occurs between the terminal lid and the gas cutoff apparatus and rainwater etc. infiltrate from this gap and the water may accumulate inside a body of the gas cutoff apparatus or the rainwater enters inside the adapter 2 through the wiring holes 1*k*, 2*k* and the controller 3 may be sunken. Particularly when the water may accumulate in the body of the gas cutoff apparatus, a flow rate is not measured normally and in some cases, the flow rate is measured accidentally or as a result of determining security based on the flow rate measured accidentally, troubles occur, for example, a gas passage is broken accidentally or in spite of the abnormal time, the gas passage is not broken. This has problems that it is inconvenient for a gas consumer or security cannot be ensured in case of an emergency from a safety standpoint.

The invention solves the problems, and provides a high-safety gas cutoff apparatus for early detecting a submerged state and immediately notifying a gas company center or stopping gas supply and ensuring security when rainwater etc. infiltrate and the inside of the gas cutoff apparatus becomes submerged due to wrong work.

Means for Solving the Problems

In order to solve the conventional problems, a gas cutoff apparatus of the invention is the gas cutoff apparatus for cutting off supply of gas when an abnormality occurs, and includes a flow rate detecting unit for measuring a flow rate, a flow rate computing unit for computing an instantaneous flow rate value from a detected value of the flow rate detecting unit, an amplification degree determining unit for determining a signal amplification degree adjusted by the flow rate detecting unit, a time measuring unit for starting timing when the instantaneous flow rate value computed by the flow rate computing unit is a predetermined flow rate or less and the signal amplification degree determined by the amplification degree determining unit is a predetermined value or more, a measurement condition setting unit for setting a measurement condition of the flow rate detecting unit from the flow rate obtained by the flow rate computing unit, a measurement ratio computing unit for obtaining a ratio measured on a predetermined measurement condition during predetermined time timed by the time measuring unit, an average flow rate computing unit for obtaining an average flow rate from the instantaneous flow rate obtained by the flow rate computing unit, an abnormality determining unit for determining the presence or absence of the abnormality from the obtained average flow rate or determining that the abnormality occurs in the flow rate detecting unit when the ratio obtained by the measurement ratio computing unit is a predetermined ratio or more, and a cutoff unit for cutting off the supply of the gas when the abnormality determining unit determines that the abnormality occurs.

Then, when rainwater etc. infiltrate and the inside of the gas cutoff apparatus becomes submerged, amplification is performed in order to detect a flow rate signal by the flow rate detecting unit and also the flow rate value varies, so that the measurement condition is changed in order to make stable measurement and when the amplification degree becomes the predetermined value or more, time measurement is started and a ratio of the measurement condition for the stable measurement is obtained after a lapse of predetermined time and when the ratio is a predetermined value or more, it is determined that the flow rate detecting unit becomes submerged due to infiltration of the rainwater etc., and gas supply to a gas appliance is stopped, so that an abnormal measurement state can be prevented from continuing and safety can be increased.

Advantage of the Invention

When the rainwater etc. infiltrate and the inside becomes submerged accidentally, the gas cutoff apparatus of the invention determines its state correctly and stops the gas supply to the gas appliance, so that a situation in which monitoring is continued without change even though safe use of the appliance by a gas consumer cannot be monitored can be prevented.

MODE FOR CARRYING OUT THE INVENTION

Figure 1:
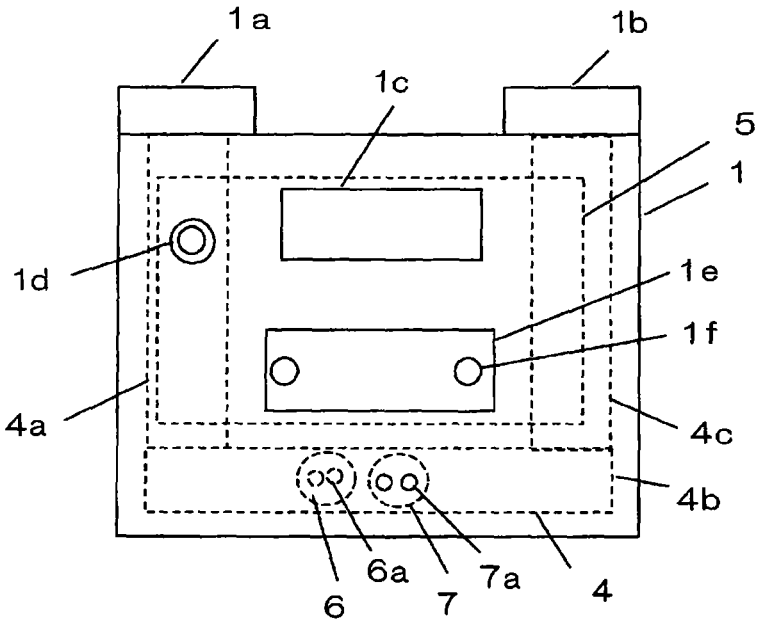
FIG. 1 is a configuration diagram of a gas cutoff apparatus in a first embodiment of the invention.

A first invention is a gas cutoff apparatus for cutting off supply of gas when an abnormality occurs, and includes a flow rate detecting unit for measuring a flow rate, a flow rate computing unit for computing an instantaneous flow rate value from a detected value of the flow rate detecting unit, an amplification degree determining unit for determining a signal amplification degree adjusted by the flow rate detecting unit, a time measuring unit for starting timing when the instantaneous flow rate value computed by the flow rate computing unit is a predetermined flow rate or less and the signal amplification degree determined by the amplification degree determining unit is a predetermined value or more, a measurement condition setting unit for setting a measurement condition of the flow rate detecting unit from the flow rate obtained by the flow rate computing unit, a measurement ratio computing unit for obtaining a ratio measured on a predetermined measurement condition during predetermined time timed by the time measuring unit, an average flow rate computing unit for obtaining an average flow rate from the instantaneous flow rate obtained by the flow rate computing unit, an abnormality determining unit for determining the presence or absence of the abnormality from the obtained average flow rate or determining that the abnormality occurs in the flow rate detecting unit when the ratio obtained by the measurement ratio computing unit is a predetermined ratio or more, and a cutoff unit for cutting off the supply of the gas when the abnormality determining unit determines that the abnormality occurs.

Then, when rainwater etc. infiltrate and the inside of the gas cutoff apparatus becomes submerged, amplification is performed in order to detect a flow rate signal by the flow rate detecting unit and also the flow rate value varies, so that the measurement condition is changed in order to make stable measurement and when the amplification degree becomes the predetermined value or more, time measurement is started and a ratio of the measurement condition for the stable measurement is obtained after a lapse of predetermined time and when the ratio is a predetermined value or more, it is determined that the flow rate detecting unit becomes submerged due to infiltration of the rainwater etc., and gas supply to a gas appliance is stopped, so that an abnormal measurement state can be prevented from continuing and safety can be increased.

A second invention is a gas cutoff apparatus for cutting off supply of gas when an abnormality occurs, and includes a flow rate detecting unit for measuring a flow rate, a flow rate computing unit for computing an instantaneous flow rate value from a detected value of the flow rate detecting unit, an amplification degree determining unit for determining a signal amplification degree adjusted by the flow rate detecting unit, a time measuring unit for starting timing when the signal amplification degree determined by the amplification degree determining unit is a predetermined value or more, a measurement condition setting unit for setting a measurement condition of the flow rate detecting unit from the flow rate obtained by the flow rate computing unit, a measurement ratio computing unit for obtaining a ratio measured on a predetermined measurement condition during predetermined time timed by the time measuring unit, an average flow rate computing unit for obtaining an average flow rate from the instantaneous flow rate obtained by the flow rate computing unit, an abnormality determining unit for determining the presence or absence of the abnormality from the obtained average flow rate or determining that the abnormality occurs in the flow rate detecting unit when the ratio obtained by the measurement ratio computing unit is a predetermined ratio or more, and a cutoff unit for cutting off the supply of the gas when the abnormality determining unit determines that the abnormality occurs.

Then, amplification is performed in order to detect a flow rate signal by the flow rate detecting unit and also the flow rate value varies, so that the measurement condition is changed in order to make stable measurement and when the amplification degree becomes the predetermined value or more, time measurement is started and a ratio of the measurement condition for the stable measurement is obtained after a lapse of predetermined time and when the ratio is a predetermined value or more, it is determined that the flow rate detecting unit becomes submerged due to infiltration of rainwater etc., and gas supply to a gas appliance is stopped, so that continuation of an abnormal measurement state can be prevented by cutting off and safety is high.

First Embodiment

Figure 2:
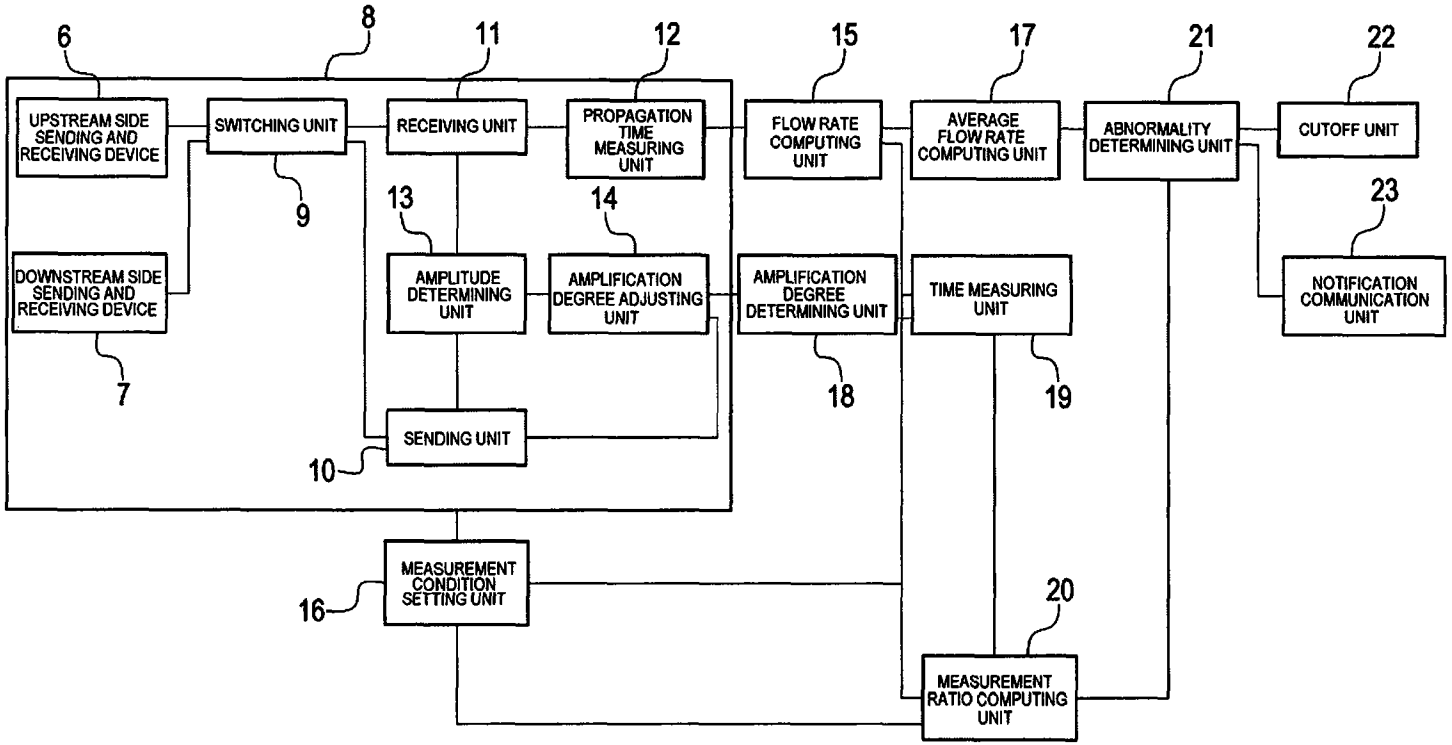
FIG. 2 is a control block diagram of the same gas cutoff apparatus.
Figure 4:
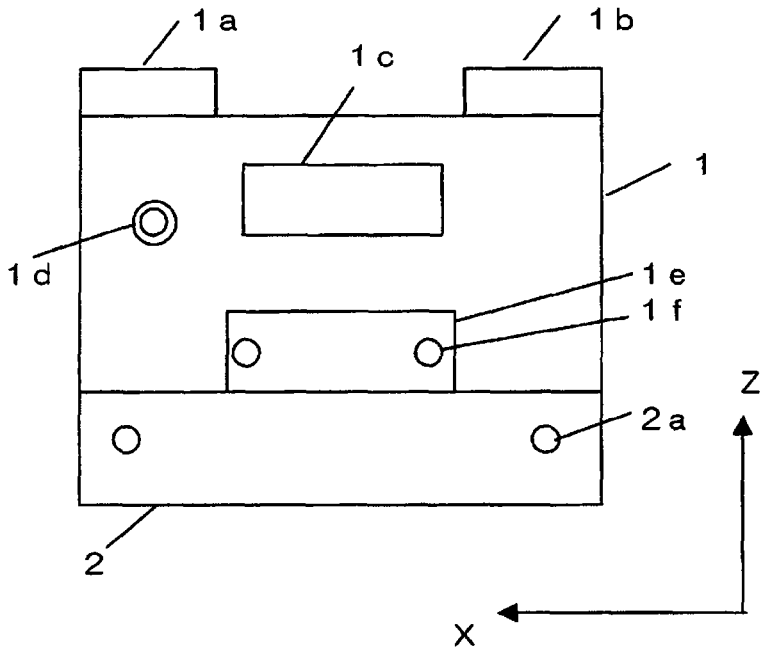
FIG. 4 is a front view of a conventional gas cutoff apparatus.
Figure 5:
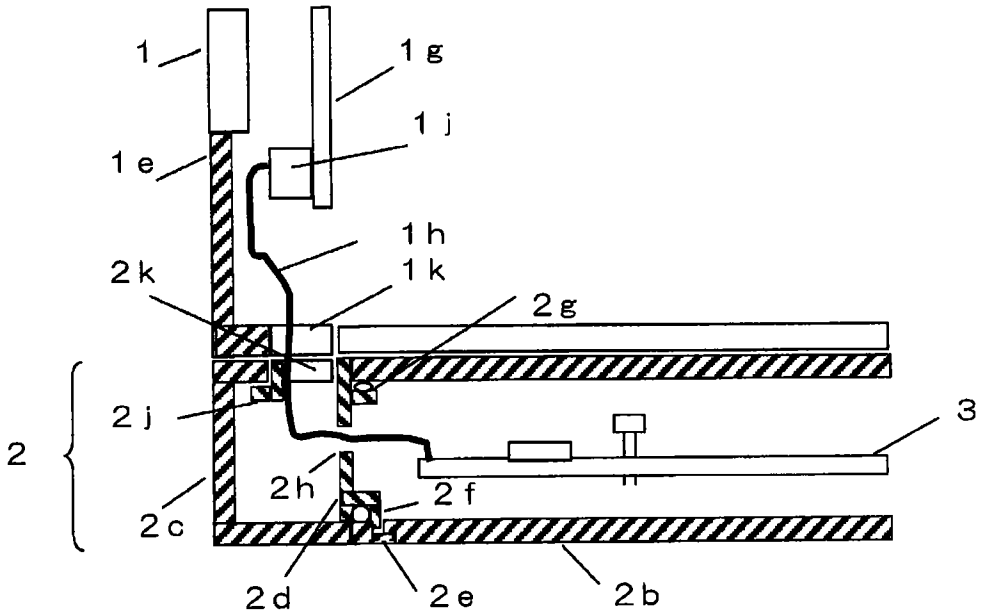
FIG. 5 is a sectional view of the same gas cutoff apparatus.

FIG. 1 is a diagram showing a schematic configuration diagram of a gas cutoff apparatus in a first embodiment of the invention, and FIG. 2 is a control block diagram of a controller mounted in the same gas cutoff apparatus. The same numerals are assigned to the same equivalences as those of FIGS. 4 and 5.

In FIG. 1, a gas cutoff apparatus 1 is installed in a garden etc. of each home and after going through this gas cutoff apparatus 1, piping is installed to a place in which various gas appliances used in each home are installed, and gas is supplied. An internal configuration of the gas cutoff apparatus 1 has a flow passage 4 and a controller 5. The flow passage 4 leads from an inflow vent 1*a* of the gas cutoff apparatus 1 to a supply vent 1*b* for supplying the gas to each of the gas appliances through an inlet side flow passage 4*a*, a bottom flow passage 4*b* and an outlet side flow passage 4*c*. An upstream side sending and receiving device 6 and a downstream side sending and receiving device 7 for sending and receiving an ultrasonic signal are oppositely attached to the flow passage 4 in a flow direction. The upstream side sending and receiving device 6 and the downstream side sending and receiving device 7 respectively include terminals 6*a*, 7*a* connected to the controller 5.

FIG. 2 is the control block diagram of the controller. A flow rate detecting unit 8 includes the upstream side sending and receiving device 6, the downstream side sending and receiving device 7, a switching unit 9, a sending unit 10, a receiving unit 11, a propagation time measuring unit 12, an amplitude determining unit 13 and an amplification degree adjusting unit 14. In the upstream side sending and receiving device 6 for sending or receiving ultrasonic waves and the downstream side sending and receiving device 7 for receiving or sending the ultrasonic waves likewise, switching of sending and receiving can be performed by the switching unit 9. The sending unit 10 for outputting an ultrasonic signal is connected to this upstream side sending and receiving device 6 or the downstream side sending and receiving device 7, and the ultrasonic signal is received in the receiving unit 11 through the upstream side sending and receiving device 6 or the downstream side sending and receiving device 7 by the switching unit 9. First, the ultrasonic signal is sent in the upstream side sending and receiving device 6 by the sending unit 10 and is received in the downstream side sending and receiving device 7, and a received signal from the receiving unit 11 is received and propagation time is measured by the propagation time measuring unit 12. Next, switching is performed by the switching unit 9 and similarly, the ultrasonic signal is sent from the downstream side toward the upstream side and the propagation time is measured. Then, an ultrasonic propagation time difference between the upstream side sending and receiving device 6 and the downstream side sending and receiving device 7 is obtained every predetermined cycle (for example, every two seconds). The amplitude determining unit 13 determines whether or not the ultrasonic signal received in the receiving unit 11 has an amplitude with proper magnitude, and when the amplitude is too large or too small, the amplitude is adjusted so as to become the proper magnitude by the amplification degree adjusting unit 14. The amplification degree adjusting unit 14 can control an amplification degree in the range from a gain value of 1 to 100 (30 to 60 dB) so that, for example, a peak voltage of received waves becomes, for example, about 500 mV. Then, the ultrasonic signal is sent from the sending unit 10 at the time of the next measurement by the adjusted amplification degree next time.

Then, the propagation time measured and obtained every predetermined cycle is converted into an instantaneous flow rate value by a flow rate computing unit 15. A measurement condition setting unit 16 controls the flow rate detecting unit 8 so that a pressure variation state of the inside of the flow passage 4 is detected from the obtained instantaneous flow rate and measurement conditions such as the number of measurements or a measurement cycle (measurement at time intervals much shorter than a normal measurement cycle, for example, two seconds) are changed stepwise and the flow rate can be measured stably without being influenced by pressure variations etc. always. Also, the instantaneous flow rate value is inputted to an average flow rate computing unit 17 and a predetermined number of instantaneous flow rate values are together gathered and are calculated as an average flow rate value. On the other hand, an amplification degree for adjusting an amplitude level of the ultrasonic signal of the flow rate detecting unit 8 is monitored by an amplification degree determining unit 18. The amplification degree tends to increase since ultrasonic signal reception sensitivity decreases as the flow rate increases normally.

When the amplification degree of the amplification degree determining unit 18 is a predetermined value or more in a state in which the instantaneous flow rate obtained by the flow rate computing unit 15 is a predetermined flow rate, for example, 1000 L/h or less, measurement by a one-hour timer for monitoring an abnormality of the flow rate detecting unit 8 is started by a time measuring unit 19. The abnormality monitoring timer is started and also, monitoring of the measurement conditions of the measurement condition setting unit 16 is started by a measurement ratio computing unit 20. The measurement conditions include measurement conditions of several steps according to a state of the pressure variations etc., and the measurement condition setting unit 16 counts the number of times which starts to be measured on the measurement condition of the predetermined step or more, and obtains a ratio of the number of times measured on the measurement condition of the predetermined step or more with respect to the number of times of all sampling capable of measuring the flow rate within the one-hour monitoring timer.

Then, an abnormality determining unit 21 monitors an appliance used by the obtained average flow rate or monitors whether or not there is an abnormality in the present flow rate detecting unit 8. When the ratio of the number of times obtained by the measurement ratio computing unit 20 becomes a predetermined ratio or more, the abnormality determining unit 21 determines that the reason why an abnormally large amplification degree occurs in the range of a normal small flow rate is because the flow rate detecting unit 8 detects an abnormal flow rate due to some cause, for example, submergence of rainwater etc., and a cutoff signal is outputted. Also, a monitoring determination value of a maximum use flow rate, a limit time value of use time corresponding every flow rate region, etc. are stored in the abnormality determining unit 21. For example, when a hose for supplying gas to a heater etc. is detached due to some cause, an abnormally large flow rate occurs, and a total flow rate cutoff value for monitoring such a state, limit time of use time cutoff for defining the limit time of the use time corresponding to the case of being used much longer than the maximum use time for which the appliance is normally used, etc. are stored. The abnormality determining unit 21 compares this set value with the average flow rate value and makes a determination and thereby, monitors, for example, whether or not the flow rate value exceeds the maximum use flow rate value or the use time of the appliance exceeds the limit time of continuous use corresponding to a registration flow rate.

When this abnormality determining unit 21 determines that an abnormality occurs, the cutoff signal is sent to a cutoff unit 22 and gas supply is stopped. Also, a notification communication unit 23 displays a cutoff state or the contents of cutoff on a liquid crystal display element etc. and also notifies a gas company center for monitoring safety of gas of the cutoff state or the contents of cutoff by communication of a telephone line etc.

Next, an action of the gas cutoff apparatus 1 constructed as mentioned above will be described. When a gas company person attempts to fix a terminal lid 1*e* by a fixing member 1*f* (a screw etc.) after the gas company person installs the gas cutoff apparatus 1 in a house of a gas consumer and opens the terminal lid 1*e* and connects a communication device, an alarm (not shown), etc., rainwater may infiltrate from a gap between the terminal lid 1*e* and a body of the gas cutoff apparatus 1 in the case where fixing of the fixing member 1*f* is loose or fastening is loose or a connecting wire etc. are pinched due to some cause. In this case, the infiltrating rainwater accumulates in the portion of the flow passage 4 located under the gas cutoff apparatus 1, and the upstream side sending and receiving device 6, the downstream side sending and receiving device 7, etc. are submerged and become a sunken state. In such a state, a flow rate is detected by the flow rate detecting unit 8. Propagation time of an ultrasonic signal is measured as a detected value and this signal is sent to the flow rate computing unit 15 and is converted as an instantaneous flow rate value and because of the sunken state, an impedance between the terminals 6*a* or 7*a* of the upstream side sending and receiving device 6 or the downstream side sending and receiving device 7 decreases, so that magnitude of the ultrasonic signal is unstable and varies. As a result, even in a flow rate state in which the appliance is not used at all, a propagation time value measured by the propagation time measuring unit 12 changes, so that the flow rate value obtained by the flow rate computing unit 15 varies. Also, since the impedance between the terminals decreases, the ultrasonic signal decreases and its state is received by the receiving unit 11 and when the amplitude determining unit 13 determines that a signal level is a predetermined value or less, the amplification degree adjusting unit 14 increases an amplification degree so that a peak value becomes 500 mV always. As a result, the amplification degree of a signal for detecting a flow rate signal increases gradually in spite of a low flow rate state in which the appliance is not used.

When the instantaneous flow rate obtained by the flow rate computing unit 15 varies, the measurement condition setting unit 16 determines that it is the same state as a flow rate state of the case where a gas pressure supplied varies when the appliance is not used from its state, and changes to a measurement condition at the time of pressure variations and performs control. That is, normally, measurements are regularly made every two seconds, and its measurement condition is changed and, for example, a measurement interval is shortened and the number of measurements is increased and the flow rate is measured stably. When the instantaneous flow rate from the flow rate computing unit 15 is a predetermined flow rate or less (for example, 1000 L/h or less) and the amplification degree determining unit 18 determines that a predetermined amplification degree (for example, a gain value of 60 or more) or more is reached, the time measuring unit 19 or the measurement ratio computing unit 20 determines that there is a possibility that the flow rate detecting unit 8 located under the gas cutoff apparatus 1 becomes abnormal because of a decrease in the impedance between the terminals due to some cause (submergence etc.), and the time measuring unit 19 starts measurement by the timer for monitoring the abnormality of the flow rate detecting unit 8. At the same time, the measurement ratio computing unit 20 changes a measurement condition with respect to the number of flow rate measurements in the abnormality monitoring timer of the time measuring unit 19, and obtains a ratio of the number of flow rate measurements. Then, when this ratio of the number of flow rate measurements reaches a predetermined ratio (for example, 80% or more), it is determined that the flow rate detecting unit 8 becomes abnormal because of the decrease in the impedance between the terminals due to the submergence etc., and a cutoff signal is outputted to the abnormality determining unit 21. When an appliance such as a GHP (a gas heat pump device) for generating pressure variations is normally used, in the measurement condition setting unit 14, measurement conditions change alternately, for example, when a pulsed state is detected, the measurement condition increases to a high level (a measurement condition that accuracy is increased) and when a stable flow rate is detected, the measurement condition decreases stepwise, and when the flow rate detecting unit 8 etc. in the gas cutoff apparatus 1 are sunken and the impedance between the terminals decreases, measurement continues to be made on the highest level of the measurement condition always.

However, a battery is normally used in a power source (not shown) of the gas cutoff apparatus and when the measurement is made on the high level of the measurement condition always as described above conventionally, the high-capacity battery is required, so that such early detection of the abnormal state has a great effect capable of a configuration by a lower-capacity battery.

When this abnormality determining unit 21 determines that an abnormality occurs, the cutoff signal is sent to the cutoff unit 22 and gas supply is stopped. Also, the notification communication unit 23 displays a cutoff state or the contents of cutoff on a liquid crystal display element etc. and also notifies a gas company center for monitoring safety of gas of the cutoff state or the contents of cutoff by communication of a telephone line etc. A gas company person can take measures to, for example, replace the gas cutoff apparatus 1 immediately, and the abnormal state can be avoided speedily.

On the other hand, in parallel, the average flow rate computing unit 12 computes instantaneous flow rates obtained by the flow rate computing unit 15 as an average flow rate value every predetermined number of instantaneous flow rates. In the obtained average flow rate, a monitoring determination value of a maximum use flow rate, a limit time value of use time corresponding every flow rate region, etc. are stored in the abnormality determining unit 21. For example, when a hose for supplying gas to a heater etc. is detached due to some cause, an abnormally large flow rate occurs, and a total flow rate cutoff value for monitoring such a state, limit time of use time cutoff for defining the limit time of the use time corresponding to the case of being used much longer than the maximum use time for which the appliance is normally used, etc. are stored. The abnormality determining unit 21 compares this set value with the average flow rate value and makes a determination and thereby, monitors, for example, whether or not the flow rate value exceeds the maximum use flow rate value or the use time of the appliance exceeds the limit time of continuous use corresponding to a registration flow rate, and in the case of exceeding the maximum use flow rate value or the limit time, the cutoff signal is outputted.

In addition, the configuration used in the embodiment is one example and also, a use form is not limited to the embodiment.

As described above, due to some cause, the terminal lid 1*e* of the gas cutoff apparatus 1 is fixed in a loose state and rainwater etc. infiltrate and the flow rate detecting unit 8 located under the gas cutoff apparatus 1 becomes submerged and worst of all, the controller 5 located over the flow rate detecting unit 8 also becomes sunken, and this abnormality of the flow rate detecting unit 8 can be early detected by monitoring an amplification degree of the amplification degree adjusting unit 14 for detecting and controlling the flow rate or a change in the flow rate signal detected from the flow rate detecting unit 8. As a result, abnormal actions, such as incorrect cutoff, in which the flow rates are measured to sum up as abnormal gas usage due to the submergence even though the appliance is not used essentially or abnormal flow rate detection actuates a security function to break gas are prevented from being caused continuously, and it is early determined that the gas cutoff apparatus for safely monitoring a gas consumer using the gas appliance is abnormal and notification is provided, so that there are effects of having extremely high safety or reliability and high usability.

Second Embodiment

Figure 3:
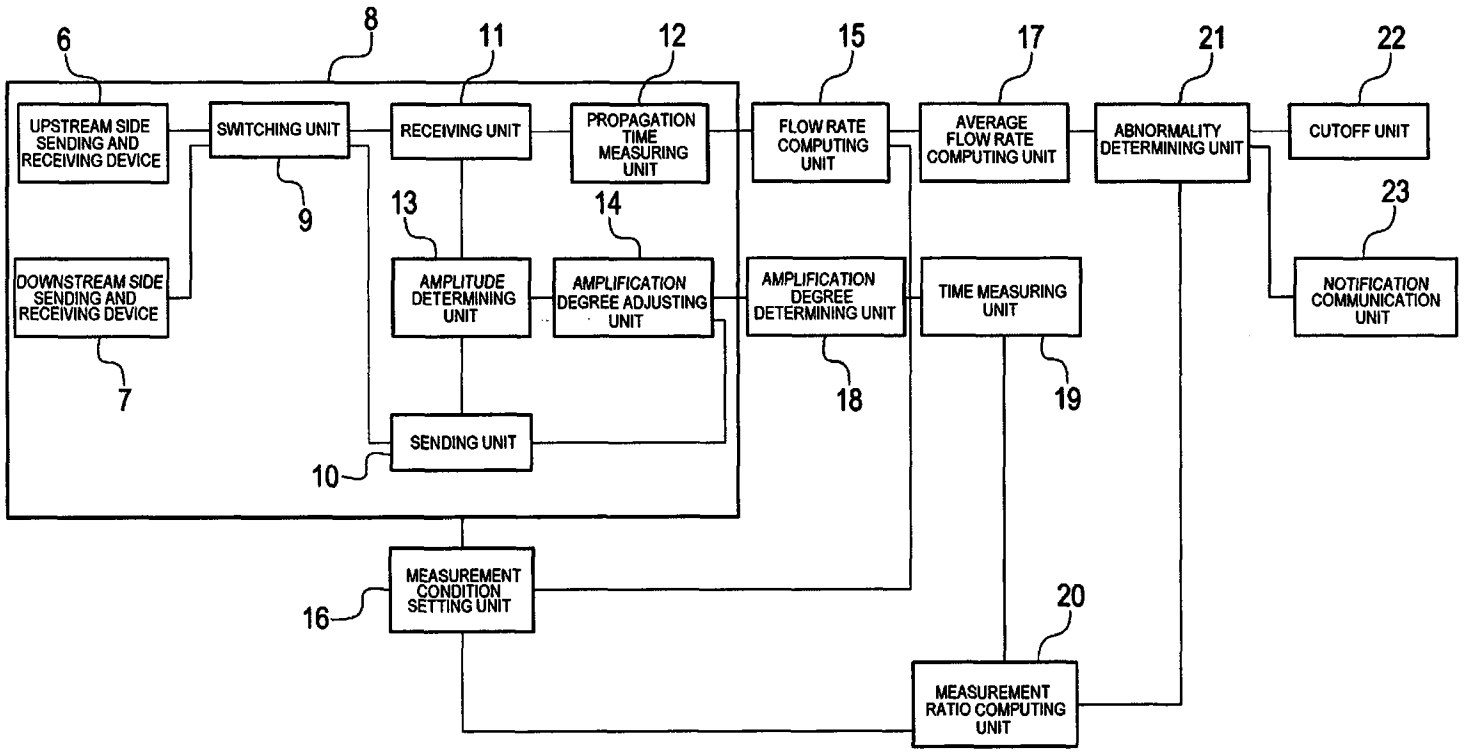
FIG. 3 is a control block diagram of the same gas cutoff apparatus in a second embodiment of the invention.

FIG. 3 is a control block diagram of a controller mounted in a gas cutoff apparatus in a second embodiment of the invention. The same numerals are assigned to the same equivalences as those of FIGS. 1, 4 and 5.

FIG. 3 is the control block diagram of the controller. A flow rate detecting unit 8 includes an upstream side sending and receiving device 6, a downstream side sending and receiving device 7, a switching unit 9, a sending unit 10, a receiving unit 11, a propagation time measuring unit 12, an amplitude determining unit 13 and an amplification degree adjusting unit 14. In the upstream side sending and receiving device 6 for sending or receiving ultrasonic waves and the downstream side sending and receiving device 7 for receiving or sending the ultrasonic waves, switching of sending and receiving can be performed by the switching unit 9. The sending unit 10 for outputting an ultrasonic signal is connected to this upstream side sending and receiving device 6 or the downstream side sending and receiving device 7, and the ultrasonic signal is received in the receiving unit 11 through the upstream side sending and receiving device 6 or the downstream side sending and receiving device 7 by the switching unit 9. First, the upstream side sending and receiving device 6 sends the ultrasonic signal by the sending unit 10 and the ultrasonic signal is received in the downstream side sending and receiving device 7, and a received signal from the receiving unit 11 is received and propagation time is measured by the propagation time measuring unit 12. Next, switching is performed by the switching unit 9 and similarly, the ultrasonic signal is sent from the downstream side toward the upstream side and the propagation time is measured. Then, an ultrasonic propagation time difference between the upstream side sending and receiving device 6 and the downstream side sending and receiving device 7 is obtained every predetermined cycle. The amplitude determining unit 13 determines whether or not the ultrasonic signal received in the receiving unit 11 has an amplitude with proper magnitude, and when the amplitude is too large or too small, the amplitude is adjusted so as to become the proper magnitude by the amplification degree adjusting unit 14. The amplification degree adjusting unit 14 can control an amplification degree in the range from a gain value of 1 to 100 (30 to 60 dB) so that, for example, a peak voltage of received waves becomes, for example, about 500 mV. Then, the ultrasonic signal is sent from the sending unit 10 at the time of the next measurement by the adjusted amplification degree next time.

Then, the propagation time measured and obtained every predetermined cycle is converted into an instantaneous flow rate value by a flow rate computing unit 15. A measurement condition setting unit 16 controls the flow rate detecting unit 8 so that a flow state of the inside of a flow passage 4 is determined from the obtained instantaneous flow rate and measurement conditions such as the number of measurements or a measurement cycle are changed and the flow rate can be measured stably always. Also, the instantaneous flow rate value is inputted to an average flow rate computing unit 17 and a predetermined number of instantaneous flow rate values are together gathered and are calculated as an average flow rate value. On the other hand, an amplification degree for adjusting an amplitude level of the ultrasonic signal of the flow rate detecting unit 8 is monitored by an amplification degree determining unit 18. The amplification degree tends to increase since ultrasonic signal reception sensitivity decreases as the flow rate increases normally.

When the amplification degree of the amplification degree determining unit 18 is a predetermined value or more, measurement by a timer for monitoring an abnormality of the flow rate detecting unit 8 is started by a time measuring unit 19. The abnormality monitoring timer is started and also, monitoring of the measurement conditions of the measurement condition setting unit 16 is started by a measurement ratio computing unit 20.

Then, an abnormality determining unit 21 monitors an appliance used by the obtained average flow rate or monitors whether or not there is an abnormality in the present flow rate detecting unit 8. When the ratio of the number of times obtained by the measurement ratio computing unit 20 becomes a predetermined ratio or more, the abnormality determining unit 21 determines that the reason why an abnormally large amplification degree occurs in the range of a normal small flow rate is because the flow rate detecting unit 8 detects an abnormal flow rate due to some cause, for example, infiltration of rainwater etc., and a cutoff signal is outputted.

Next, an action of the gas cutoff apparatus 1 constructed as mentioned above will be described. When a gas company person attempts to fix a terminal lid 1*e* by a fixing member 1*f* (a screw etc.) after the gas company person installs the gas cutoff apparatus 1 in a house of a gas consumer and opens the terminal lid 1*e* and connects a communication device, an alarm (not shown), etc., rainwater may infiltrate from a gap between the terminal lid 1*e* and a body of the gas cutoff apparatus 1 in the case where fixing of the fixing member 1*f* is loose or fastening is loose or a connecting wire is pinched due to some cause. In this case, the submerged rainwater accumulates in the portion of the flow passage 4 located under the gas cutoff apparatus 1, and the upstream side sending and receiving device 6, the downstream side sending and receiving device 7, etc. are submerged and become a sunken state. In such a state, a flow rate is detected by the flow rate detecting unit 8. Propagation time of an ultrasonic signal is measured as a detected value and this signal is sent to the flow rate computing unit 15 and is converted as an instantaneous flow rate value and because of the sunken state, an impedance between terminals 6*a* or 7*a* of the upstream side sending and receiving device 6 or the downstream side sending and receiving device 7 decreases, so that magnitude of the ultrasonic signal is unstable and varies. As a result, even in a flow rate state in which the appliance is not used at all, a propagation time value measured by the propagation time measuring unit 12 changes, so that the flow rate value obtained by the flow rate computing unit 15 varies. Also, since the impedance between the terminals decreases, the ultrasonic signal decreases and its state is received by the receiving unit 11 and when the amplitude determining unit 13 determines that a signal level is a predetermined value or less, the amplification degree adjusting unit 14 increases an amplification degree so that a peak value becomes 500 mV always. As a result, the amplification degree of a signal for detecting a flow rate signal increases gradually in spite of a low flow rate state in which the appliance is not used.

When the instantaneous flow rate obtained by the flow rate computing unit 15 varies, the measurement condition setting unit 16 determines that it is the same state as a flow rate state of the case where a gas pressure supplied varies when the appliance is not used from its state, and changes to a measurement condition at the time of pressure variations and performs control. That is, measurements are regularly made, and the number of measurements is increased or the measurements are made in a measurement cycle shorter than a normal measurement cycle and the flow rate is measured stably. When the amplification degree determining unit 18 determines that a predetermined amplification degree (for example, a gain value of 60 or more) or more is reached, the time measuring unit 19 or the measurement ratio computing unit 20 determines that there is a possibility that the flow rate detecting unit 8 located under the gas cutoff apparatus 1 becomes abnormal because of a decrease in the impedance between the terminals due to some cause (submergence etc.), and the time measuring unit 19 starts measurement by the timer for monitoring the abnormality of the flow rate detecting unit 8. At the same time, the measurement ratio computing unit 20 changes a measurement condition with respect to the number of flow rate measurements in the abnormality monitoring timer of the time measuring unit 19, and obtains a ratio of the number of flow rate measurements. Then, when this ratio of the number of flow rate measurements reaches a predetermined ratio (for example, 80% or more), it is determined that the flow rate detecting unit 8 becomes abnormal because of the decrease in the impedance between the terminals due to the submergence etc., and a cutoff signal is outputted to an abnormality determining unit 21. When an appliance such as a GHP for generating pressure variations is normally used, in the measurement condition setting unit 14, measurement conditions change alternately, for example, when a pulsed state is detected, the measurement condition increases to a high level (a measurement condition that accuracy is increased) and when a stable flow rate is detected, the measurement condition decreases stepwise, and when the flow rate detecting unit 8 etc. in the gas cutoff apparatus 1 are sunken and the impedance between the terminals decreases, measurement continues to be made on the highest level of the measurement condition always.

However, a battery is normally used in a power source (not shown) of the gas cutoff apparatus and when the measurement is made on the high level of the measurement condition always as described above conventionally, the high-capacity battery is required, so that such early detection of the abnormal state and taking measures such as warning or cutoff have a great effect.

When this abnormality determining unit 21 determines that an abnormality occurs, the cutoff signal is sent to a cutoff unit 22 and gas supply is stopped. Also, a notification communication unit 23 displays a cutoff state or the contents of cutoff on a liquid crystal display element etc. and also notifies a gas company center for monitoring safety of gas of the cutoff state or the contents of cutoff by communication of a telephone line etc. A gas company person can take measures to, for example, replace the gas cutoff apparatus 1 immediately, and the abnormal state can be avoided speedily.

On the other hand, in parallel, the average flow rate computing unit 12 computes instantaneous flow rates obtained by the flow rate computing unit 15 as an average flow rate value every predetermined number of instantaneous flow rates. In the obtained average flow rate, a monitoring determination value of a maximum use flow rate, a limit time value of use time corresponding every flow rate region, etc. are stored in the abnormality determining unit 21. For example, when a hose for supplying gas to a heater etc. is detached due to some cause, an abnormally large flow rate occurs, and a total flow rate cutoff value for monitoring such a state, limit time of use time cutoff for defining the limit time of the use time corresponding to the case of being used much longer than the maximum use time for which the appliance is normally used, etc. are stored. The abnormality determining unit 21 compares this set value with the average flow rate value and makes a determination and thereby, monitors, for example, whether or not the flow rate value exceeds the maximum use flow rate value or the use time of the appliance exceeds the limit time of continuous use corresponding to a registration flow rate, and in the case of exceeding the maximum use flow rate value or the limit time, the cutoff signal is outputted.

In addition, the configuration used in the embodiment is one example and also, a use form is not limited to the embodiment.

As described above, due to some cause, the terminal lid 1*e* of the gas cutoff apparatus 1 is fixed in a loose state and rainwater etc. infiltrate and the flow rate detecting unit 8 located under the gas cutoff apparatus 1 becomes submerged and worst of all, a controller 5 located over the flow rate detecting unit 8 also becomes sunken, and this abnormality of the flow rate detecting unit 8 can be early detected by monitoring an amplification degree of the amplification degree adjusting unit 14 for detecting and controlling the flow rate or a change in the flow rate signal detected from the flow rate detecting unit 8. As a result, abnormal actions, such as a malfunction, in which the flow rates are measured to sum up as abnormal gas usage due to the submergence even though the appliance is not used essentially or abnormal flow rate detection actuates a security function to break gas are prevented from being caused continuously, and it is early determined that the gas cutoff apparatus for safely monitoring a gas consumer using the gas appliance is abnormal and notification is provided, so that there are effects of having extremely high safety or reliability and high usability.

In addition, in the case of creating a program for executing all or a part of the unit of the gas cutoff apparatus according to the embodiments described above, the invention can be implemented using a microcomputer etc. and also by recording this program on a recording medium or delivering the program using a communication line, distribution or installation can be performed easily.

The present application is based on Japanese patent application (patent application No. 2008-164091) filed on Jun. 24, 2008, and the contents of the patent application are hereby incorporated by reference.

The various embodiments of the invention have been described above, but the invention is not limited to the items shown in the embodiments described above, and the invention intends to make change and application by persons skilled in the art based on well-known techniques and the mention of the description, and the change and application are included in the scope of protection.

INDUSTRIAL APPLICABILITY

As described above, the gas cutoff apparatus according to the invention can detect an abnormal state of the case of being submerged due to rainwater etc. and determine that it is difficult to continue measurement of a flow rate or security monitoring, and can similarly be applied to all appliance monitoring devices of a water meter, a digital power meter, etc.

DESCRIPTION OF REFERENCE NUMERALS AND SIGNS

8 FLOW RATE DETECTING UNIT
15 FLOW RATE COMPUTING UNIT
16 MEASUREMENT CONDITION SETTING UNIT
17 AVERAGE FLOW RATE COMPUTING UNIT
18 AMPLIFICATION DEGREE DETERMINING UNIT
19 TIME MEASURING UNIT
20 MEASUREMENT RATIO COMPUTING UNIT
21 ABNORMALITY DETERMINING UNIT
22 CUTOFF UNIT

The invention claimed is:

1. A gas cutoff apparatus for cutting off supply of gas when an abnormality occurs, comprising:

a flow rate detecting unit for measuring a flow rate using an ultrasonic signal;

an amplification degree adjusting unit for adjusting a signal amplification degree for the ultrasonic signal depending on an amplitude of the ultrasonic signal;

a flow rate computing unit for computing an instantaneous flow rate value from the flow rate measured by the flow rate detecting unit;

an amplification degree determining unit for determining the signal amplification degree adjusted by the amplification degree adjusting unit;

a time measuring unit for starting timing when the instantaneous flow rate value computed by the flow rate computing unit is a predetermined flow rate or less and the signal amplification degree determined by the amplification degree determining unit is a predetermined value or more;

a measurement condition setting unit for changing a measurement condition of the flow rate detecting unit based on the flow rate obtained by the flow rate computing unit, wherein the measurement condition is selected from a plurality of different stepwise measurement conditions for measuring the flow rate;

a measurement ratio computing unit for obtaining a ratio of a number of times measured on one or more of the different stepwise measurement conditions with respect to a number of times measured on all of the plurality of different stepwise measurement conditions during predetermined time timed by the time measuring unit;

an average flow rate computing unit for obtaining an average flow rate from the instantaneous flow rate obtained by the flow rate computing unit;

an abnormality determining unit for determining the presence or absence of the abnormality from the obtained average flow rate or determining that the abnormality occurs in the flow rate detecting unit when the ratio obtained by the measurement ratio computing unit is a predetermined ratio or more; and a cutoff unit for cutting off the supply of the gas when the abnormality determining unit determines that the abnormality occurs.

2. A gas cutoff apparatus for cutting off supply of gas when an abnormality occurs, comprising:

a flow rate detecting unit for measuring a flow rate using an ultrasonic signal;

an amplification degree adjusting unit for adjusting a signal amplification degree for the ultrasonic signal depending on an amplitude of the ultrasonic signal;

a flow rate computing unit for computing an instantaneous flow rate value from the flow rate measured by the flow rate detecting unit;

an amplification degree determining unit for determining the signal amplification degree adjusted by the amplification degree adjusting unit;

a time measuring unit for starting timing when the signal amplification degree determined by the amplification degree determining unit is a predetermined value or more;

a measurement condition setting unit for changing a measurement condition of the flow rate detecting unit based on the flow rate obtained by the flow rate computing unit, wherein the measurement condition is selected from a plurality of different stepwise measurement conditions for measuring the flow rate;

a measurement ratio computing unit for obtaining a ratio of a number of times measured on a particular one or more different stepwise measurement conditions with respect to a number of times measured on all of the plurality of different stepwise measurement conditions during predetermined time timed by the time measuring unit;

an average flow rate computing unit for obtaining an average flow rate from the instantaneous flow rate obtained by the flow rate computing unit;

an abnormality determining unit for determining the presence or absence of the abnormality from the obtained average flow rate or determining that the abnormality occurs in the flow rate detecting unit when the ratio obtained by the measurement ratio computing unit is a predetermined ratio or more; and a cutoff unit for cutting off the supply of the gas when the abnormality determining unit determines that the abnormality occurs.

3. The gas cutoff apparatus according to claim 1, wherein the measurement ratio computing unit obtains a ratio of a number of times measured on a highest level measurement condition of the different stepwise measurement conditions with respect to the number of times measured on all of the plurality of different stepwise measurement conditions during predetermined time timed by the time measuring unit.

4. The gas cutoff apparatus according to claim 2, wherein the measurement ratio computing unit obtains a ratio of a number of times measured on a highest level measurement condition of the different stepwise measurement conditions with respect to the number of times measured on all of the plurality of different stepwise measurement conditions during predetermined time timed by the time measuring unit.

* * * * *